US006082551A

United States Patent [19]

Kai

[11] Patent Number: 6,082,551

[45] Date of Patent: Jul. 4, 2000

[54] VIBRATION-TYPE SCREENING MACHINE

[75] Inventor: Minoru Kai, Sue-machi, Japan

[73] Assignee: Kyushu Screen Co., Ltd., Fukuoka, Japan

[21] Appl. No.: 09/144,016

[22] Filed: Aug. 31, 1998

[51] Int. Cl.[7] ..... B07B 1/10

[52] U.S. Cl. ..... 209/307; 209/308; 209/366.5; 209/367; 209/400

[58] Field of Search ..... 209/307, 308, 209/272, 364, 366, 366.5, 367, 400

[56] References Cited

U.S. PATENT DOCUMENTS

| | | | |
|---|---|---|---|
| 3,254,766 | 6/1966 | Anderson | 209/400 X |
| 4,120,785 | 10/1978 | Kanamori et al. | 209/400 X |
| 4,146,483 | 3/1979 | Lee | 209/272 X |
| 4,692,240 | 9/1987 | Arbuthnot et al. | 209/272 X |

FOREIGN PATENT DOCUMENTS

| | | | |
|---|---|---|---|
| 1456249 | 2/1989 | U.S.S.R. | 209/272 |

*Primary Examiner*—David H. Bollinger
*Attorney, Agent, or Firm*—James Ray & Associates

[57] ABSTRACT

A vibration-type screening machine capable of screening loose material with a significantly enhanced efficiency includes a stationary base frame, a pair of upstanding side plates supported on the stationary base frame through spring suspensions and disposed substantially in parallel with each other so as to extend longitudinally of the screening machine, a plurality of sieve mesh supporting rollers rotatably mounted between the upstanding side plates, an endless sieve mesh web disposed between the upstanding side plates with an upper span section thereof being supported on the plurality of sieve mesh supporting rollers so that the endless sieve mesh web can endlessly move in a direction longitudinally of the screening machine from a loading port toward a discharging port, a driving unit moving endlessly the endless sieve mesh web, and an eccentric rotating vibrating mechanism disposed at a position near to the loading port and operatively coupled to the pair of upstanding side plates so that the sieve mesh supporting rollers and the upper span section undergo vibration, being driven by the eccentric rotary vibrating mechanism. The loose material loaded into the machine is caused to move on and along the upper span section of the endless sieve mesh web from the loading port toward the discharging port with undersize passing through the upper span section to be discharged laterally.

10 Claims, 2 Drawing Sheets

VIBRATION-TYPE SCREENING MACHINE

BACKGROUND OF THE INVENTION

1. Field of the Invention

The present invention relates to a vibration-type (or shaking-type) screening machine for screening or sieving or classifying loose materials such as, for example, crushed stones typified by limestone, sandstone, basalt, andesite and silica or the like.

2. Description of the Related Art

Heretofore, there is known a vibration-type or shaking-type screening machine in which a sieve mesh is combined with lateral shrouds or side plates in the form of an integrally assembly which undergoes vibration for screening the loaded raw materials. However, the conventional vibration-type screening machine suffers drawbacks that lots of time is taken for the raw material to pass through the sieve mesh and that the screening or classifying efficiency is very low.

SUMMARY OF THE INVENTION

In the light of the state of the art mentioned above, it is an object of the present invention to provide an epoch-making vibration-type (or shaking-type) screening machine which is capable of screening, sieving or classifying loose material such as crushed stone fragments with a significantly enhanced efficiency.

In view of the above and other objects, which will become apparent as the description proceeds, there is provided according to an aspect of the present invention a vibration-type screening machine for screening loose material, which machine includes a stationary base frame, a pair of upstanding side plates supported on the stationary base frame through the medium of first spring suspensions, respectively, and disposed substantially in parallel with each other with a distance therebetween so as to extend longitudinally of the vibration-type screening machine, a plurality of sieve mesh supporting rollers rotatably mounted between the upstanding side plates, an endless sieve mesh web disposed between the upstanding side plates with an upper span section thereof being supported on the plurality of sieve mesh supporting rollers so that the endless sieve mesh web can endlessly move in a direction longitudinally of the vibration-type screening machine from a loading port at which the loose material is loaded toward a discharging port thereof at which oversize of the loose material is discharged, a first driving means for moving endlessly the endless sieve mesh web in a direction longitudinally of the vibration-type screening machine from the loading port of the vibration-type screening machine toward the discharging port, and an eccentric rotary vibrating mechanism disposed at a position near to the loading port and operatively coupled to the pair of upstanding side plates so that the sieve mesh supporting rollers and the upper span section of the endless sieve mesh web undergo vibration, being driven by the eccentric rotary vibrating mechanism, wherein the loose material which is charged into the vibration-type screening machine is caused to move on and along the upper span section of the endless sieve mesh web from the loading port toward the discharging port with undersize passing through the upper span section to be discharged laterally from a space defined between the upper span section and a lower span section of the endless sieve mesh web.

In a preferred mode for carrying out the invention, the vibration-type screening machine may further include an undersize discharging hopper disposed within the above-mentioned space for discharging the undersize in a lateral direction substantially orthogonal to the longitudinal direction of the machine.

In another preferred mode for carrying out the invention, the eccentric rotary vibrating mechanism may include a pair of bearing blocks supported on the stationary base frame through the medium of the first spring suspension and disposed at outer sides of the upstanding side plates, respectively, an eccentric cam shaft supported rotatably by the bearing blocks, the eccentric cam shaft extending through the upstanding side plates substantially in parallel with the upper span section of the endless sieve mesh web, and a second driving means for rotating the eccentric cam shaft in a direction conforming to the direction in which the upper span section of the endless sieve mesh web is moved so that the upper span section of the endless sieve mesh web undergoes vibration in the course of moving from the loading port toward the discharging port of the screening machine.

In yet another preferred mode for carrying out the invention, the eccentric cam shaft may be supported rotatably by a pair of bearings mounted on outer wall surfaces of the upstanding side plates, respectively, and may include a projecting shaft and an elongated projecting shaft both projecting from both ends of the eccentric cam shaft, respectively, with eccentricity from a center axis of the eccentric cam shaft, wherein the elongated projecting shaft is operatively coupled to a driving electric motor by way of a pulley and an endless belt.

In still another preferred mode for carrying out the invention, the driving electric motor may be supported resiliently and swingably substantially in a vertical direction.

In a further preferred mode for carrying out the invention, the upstanding side plates may be mechanically connected to each other by a stopper plate at an end located at the loading port for preventing the loose material as charged from falling outside of the upper span section of the endless sieve mesh web.

In a yet further preferred mode for carrying out the invention, the upstanding side plates may be supported on the stationary base frame through the medium of second spring suspensions, respectively, at positions closer to the discharging port of the upper span section of the endless sieve mesh web.

In a still further preferred mode for carrying out the invention, the endless sieve mesh web may be formed of a first layer including a plurality of woof (or weft) wires extending substantially transversely of the vibration-type screening machine and a second layer including a plurality of warp wires extending substantially longitudinally of the vibration-type screening machine, the first layer of woof wires being disposed on the second layer of warp wires and secured to the second layer of warp wires at intersections between the woof wires and the warp wires.

In a further preferred mode for carrying out the invention, the woof wires and the warp wires may be formed of a synthetic resin.

In yet further preferred mode for carrying out the invention, the first layer of woof wires and the second layer of warp wires may be integrally combined with each other.

In a further preferred mode for carrying out the invention, the first driving means may include a variable-speed electric motor so that the endless sieve mesh web can be transported at a speed which can be adjusted.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
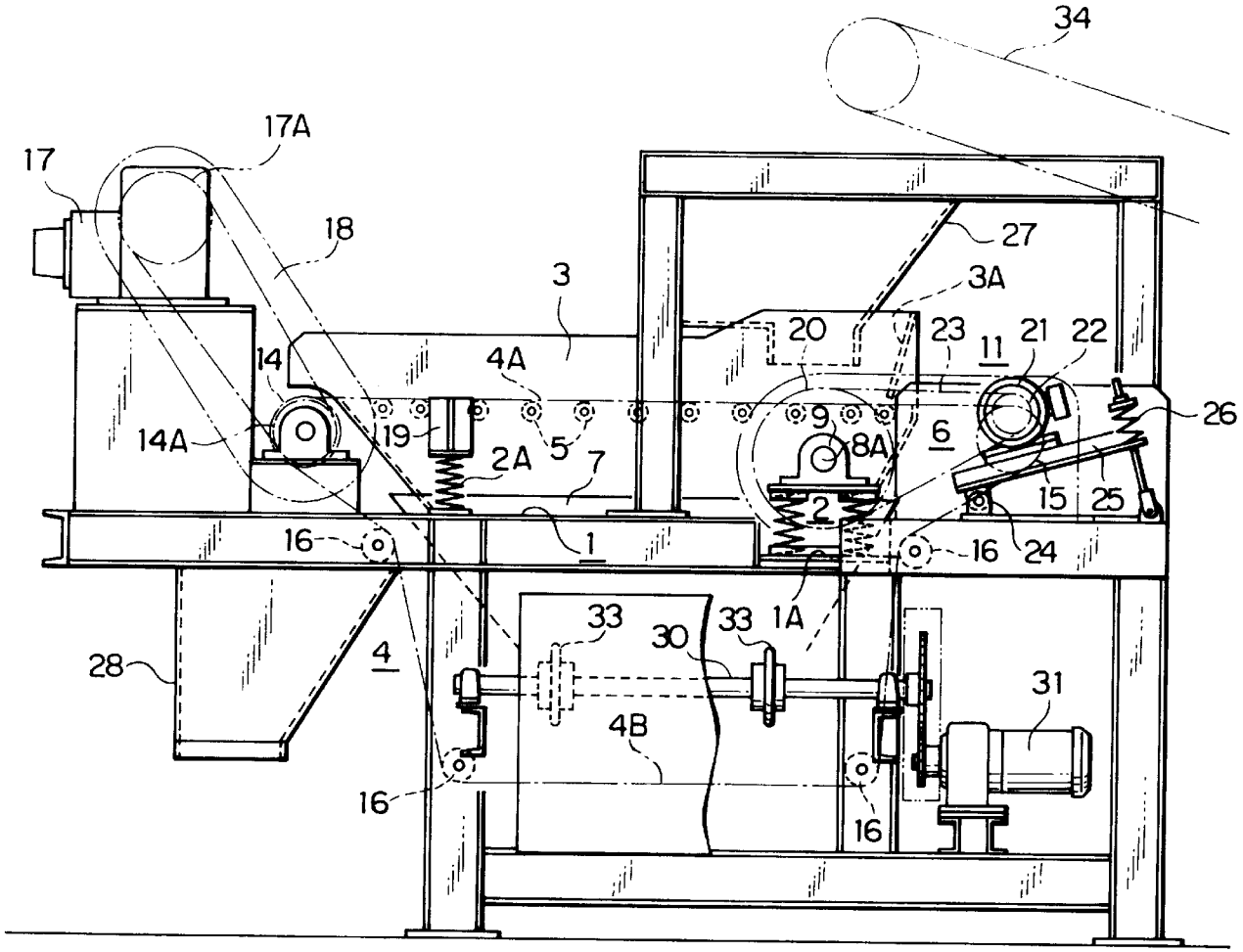
FIG. 1 is a side elevational view showing schematically a structure of the vibration-type screening machine according to an exemplary embodiment of the present invention.

The present invention will be described in detail in conjunction with what is presently considered as preferred or typical embodiments thereof by reference to the drawings. In the following description, like reference characters designate like or corresponding parts throughout the several views.

Figure 2:
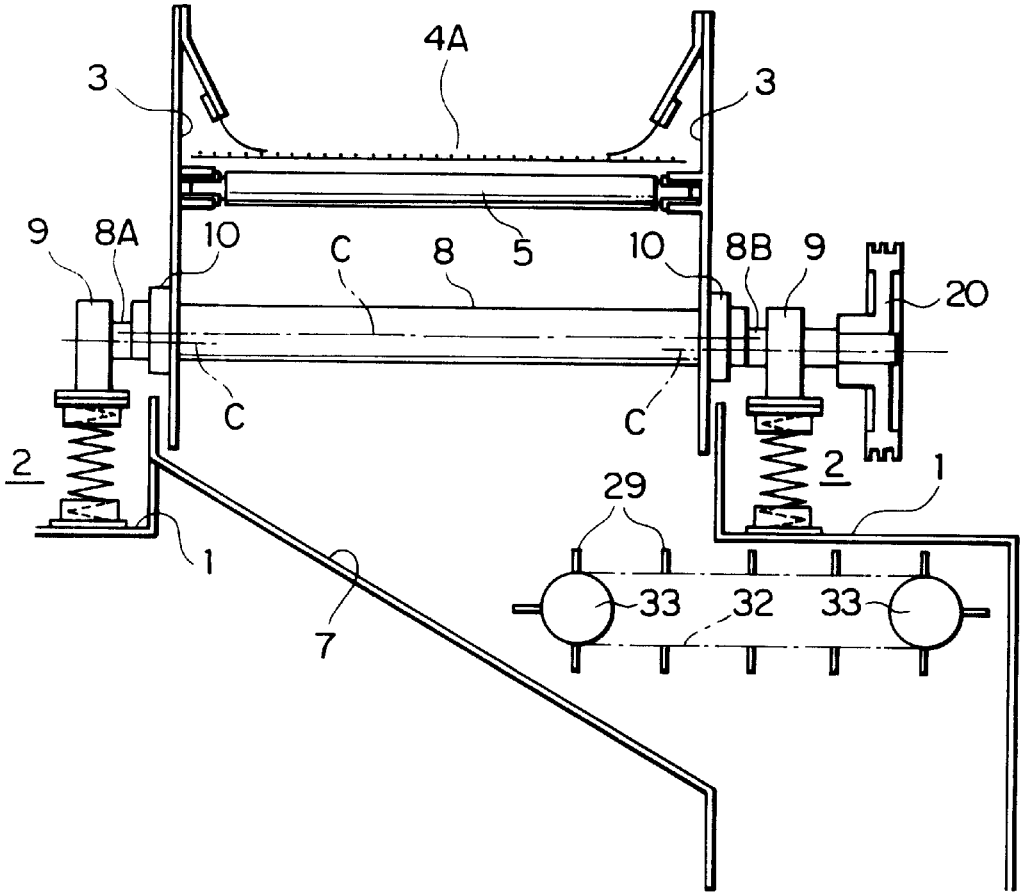
FIG. 2 is a vertical sectional view of the same taken at a raw material loading side of the screening machine shown in FIG. 1.

Now, description will be made of the vibration or shaking-type screening machine according to an embodiment of the present invention by reference to FIGS. 1 and 2, wherein FIG. 1 is a side elevational view showing schematically a structure of the vibration-type screening machine according to an exemplary embodiment of the present invention and FIG. 2 is a vertical sectional view of the same taken at a raw material loading side of the machine. In the figure, reference numeral 1 denotes a stationary base frame, at the top of which there are disposed a pair of upstanding side plates 3 extending in parallel with each other in a direction longitudinally of the screening machine. At a raw material loading side of the screening machine, upper portions of the upstanding side plates 3 are connected to each other by a stopper plate 3A which serves for preventing the raw material as loaded from falling outside of the screening machine. Thus, the upstanding side plates 3 and the stopper plate 3A cooperate to form a sieve frame of a substantially rectangular form opened at an oversize discharging side of the screening machine.

Disposed between the upstanding side plates 3 at upper portions thereof are a plurality of sieve mesh supporting rollers 5 at a pitch of ca. 150 mm which are mounted freely rotatably. These sieve mesh supporting rollers 5 serve for supporting an upper span section 4A of an endless sieve mesh web 4. Further, a driving roller 14 for moving the endless sieve mesh web 4 along a closed loop path is installed between the upstanding side plates 3 at the oversize discharging port of the screening machine. On the other hand, a follower roller 15 is installed at the raw material loading side of the screening machine for moving the endless sieve mesh web 4 through cooperation with the follower roller 15. Both the driving roller 14 and the follower roller 15 are disposed on a substantially same horizontal plane.

The endless sieve mesh web 4 having passed around the driving roller 14 is fed back toward the follower roller 15 along a path extending through a lower portion of the stationary base frame 1, being guided by four guide rollers 16. The driving roller 14 is rotationally driven by a variable-speed electric motor 17 which is mounted at a location above the stationary base frame 1 and which constitutes a part of first driving means. To this end, a driving sprocket 17A is mounted on the output shaft of the variable-speed electric motor 17 while a driven sprocket 14A is mounted fixedly on a rotatable shaft of the driving roller 14, wherein an endless chain 18 is spanned between and around the driving sprocket 17A and the driven sprocket 14A. With the arrangement described above, the endless sieve mesh web 4 can be moved endlessly between the driving roller 14 and the follower roller 15 by the variable-speed electric motor 17 by way of the power transmission mechanism constituted by the driving sprocket 17A, the driven sprocket 14A and the endless chain 18. In practical application, the endless sieve mesh web 4 may be moved or driven at a speed in a range of 42 to 64 m/min. Furthermore, the moving speed of the endless sieve mesh web 4 can be adjusted or regulated through the variable-speed electric motor 17 by taking into account the moisture content of the raw material as loaded or charged.

As can be seen in FIG. 1, supporting legs 19 are secured to the outer walls of the upstanding side plates 3 at locations near to the top edges thereof, respectively, in the vicinity of the oversize discharging region of the screening machine, wherein a spring suspension (second spring suspension means) 2A implemented in the form of a coil spring is disposed between the top surface of the stationary base frame 1 and the bottom surface of each supporting leg 19. In this conjunction, it should be mentioned that a wheel or caster (not shown) may be mounted on the bottom surface of each of the supporting legs 19 so that the supporting legs 19 can move slidably to some extent on the stationary base frame 1.

Further disposed at the outer sides of the upstanding side plates 3, respectively, at an intermediate height position thereof in a region near to the raw material loading port or region of the screening machine are bearing blocks 9 each of which is implemented in the form of a pillow block and is supported by a spring suspension (first spring suspension means) 2 formed of a spring coil which in turn is received within a receiving recess 1A formed in the stationary base frame 1 (see FIGS. 1 and 2). On the other hand, an eccentric cam shaft 8 is rotatably supported between the upstanding side plates 3 by a pair of bearings 10. Projecting axially and outwardly from both ends of the eccentric cam shaft 8 in the opposite directions, respectively, are a projecting shaft 8A and an elongated projecting shaft 8B which are rotatably received by the bearing blocks 9, respectively. In this conjunction, it should be noted that the projecting shaft 8A and the elongated projecting shaft 8B are aligned with each other and the elongated projecting shaft 8B is formed longer than the other projecting shaft 8A, wherein a pulley 20 is mounted on the elongated projecting shaft 8B at a free end portion thereof. It should further be mentioned that both the projecting shafts 8A and 8B are positioned relative to the eccentric cam shaft 8 such that the center axis of the latter is deviated from the center axes C' of the projecting shafts 8A and 8B so that the shaft 8 performs an eccentric cam function, as described hereinafter. This is the reason why the shaft 8 is called the eccentric cam shaft 8. The arrangement mentioned above can best be seen in FIG. 2. The pulley 20 fixedly mounted on the elongated projecting shaft 8B is operatively coupled to the output shaft of a driving electric motor (constituting a part of second driving means) 21 by means of an endless belt 23 spanned between and around the pulley 20 and a smaller-diameter pulley 22 which is fixedly mounted on the output shaft of the driving electric motor 21

(see FIG. 1). Thus, by electrically energizing the driving electric motor 21, the eccentric cam shaft 8 is forced to rotate eccentrically relative to the fixed center axis defined by the center axes of the projecting shafts 8A and 8B. As a result of the so-called eccentric cam action of the eccentric cam shaft 8, both the upstanding side plates 3 are caused to vibrate, following the eccentric rotation of the eccentric cam shaft 8. In this manner, the eccentric cam shaft 8, the projecting shafts 8A and 8B, the pulley 20, the small-diameter pulley 22 and the endless belt 23 cooperate to constitute an eccentric rotary vibrating mechanism denoted generally by a reference numeral 6 (see FIG. 1).

The driving electric motor 21 for the eccentric rotary vibrating mechanism 6 is mounted on a swingable base plate 25 having one end (left-hand end as viewed in FIG. 1) pivotally connected to the stationary base frame 1 by means of a pin 24 while the other end of the swingable base plate 25 (right-hand end as viewed in FIG. 1) is sustained by means of a coil spring 26. Owing to the mounting structure of the swingable base plate 25 mentioned above, vibration to which the swingable base plate 25 is subjected can be mitigated. Incidentally, the driving electric motor 21 inclusive of the resilient supporting structure therefor cooperate to constitute a second driving means generally denoted by reference numeral 11.

A raw material loading hopper 27 is installed immediately above the loading port (loading region) of the upper span section 4A of the endless sieve mesh web 4. Further, an undersize discharging hopper 7 is provided between the upper span section 4A and a lower span section 4B of the endless sieve mesh web 4 in such disposition that the passing fragments or so-called undersize passed through the upper span section 4A of the endless sieve mesh web 4 can be discharged or delivered in a direction laterally of the stationary base frame 1. On the other hand, the retained fragments or so-called oversize can be discharged from the vibration-type screening machine by way of an oversize discharging hopper 28 installed at the oversize discharging port of the endless sieve mesh web 4.

Figure 3:
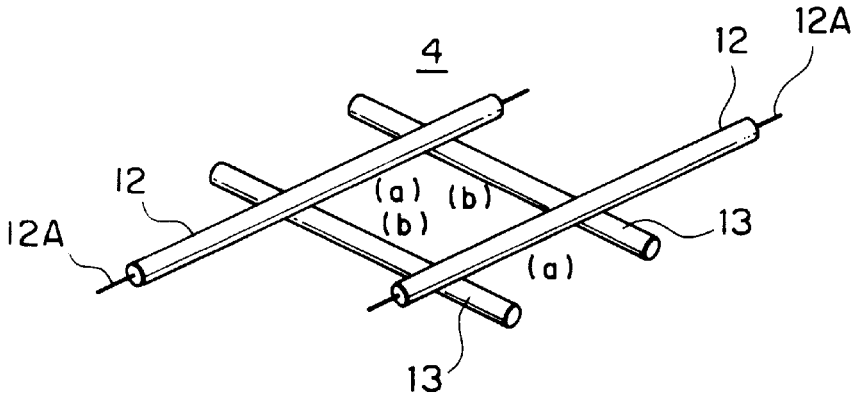
FIG. 3 is a partially enlarged view of a sieve mesh web employed in the vibration-type screening machine shown in FIG. 1.

Now, referring to FIG. 3 showing a portion of the endless sieve mesh web 4 on an exaggerated scale, the endless sieve mesh web 4 is formed of woof (weft) wires 12 and warp wires 13 each of which is formed preferably of a synthetic resin material and has a mesh size (opening of the sieve) of 3 mm or less on the assumption that vibration-type screening machine now under consideration is indented for screening stone fragments of relatively small sizes. However, it should be appreciated that the present invention is never restricted to any specific mesh size. In other words, the mesh size of the endless sieve mesh web 4 can be selected appropriately in view of practical applications for which the vibration-type screening machine is intended.

As can be seen in FIG. 3, each of the woof wires 12 has a core wire 12A embedded therein for the purpose of reinforcement. A plurality of woof (weft) wires 12 form a woof layer while a plurality of warp wires 13 form a warp layer, wherein the woof layer is disposed on the warp layer (see FIG. 3). The woof wires 12 and the warp wires 13 are integrally interconnected. With the mesh structure described above, the stone fragments are brought into contact with the woof wires 12 and the warp wires 13, respectively, of the upper span section 4A upon screening operation. In other words, the stone fragments are caused to contact twice with the wires 12 and 13 stacked vertically, as a result of which the stone fragments can pass through the meshes of the endless sieve mesh web 4 at a significantly increased rate, which in turn contributes to increasing the screening efficiency or classifying efficiency. More specifically, the stone fragments first contact the woof (weft) wires 12 at locations (a) and then contact the warp wires 13 at locations (b). Thus, the frictional resistance between the stone fragments and the meshes of the upper span section 4A can be reduced to a half when compared with the conventional woven mesh web. Besides, clogging or jamming of the meshes can be suppressed significantly.

In operation of the vibration-type screening machine, the sieve mesh supporting rollers 5 and hence the upper span section 4A of the mesh web 4 undergo vibration substantially in the vertical direction as the upstanding side plates 3 are shaken by the eccentric rotary vibrating mechanism 6 as described hereinbefore. Thus, the raw material stone fragments can be sieved effectively and speedily at a high rate while bouncing off the top surface of the upper span section 4A in the course of moving from the loading port to the discharging port of the screening machine.

An undersize discharging scraper mechanism 29 is disposed within the undersize discharging hopper 7 for discharging the undersize from the screening machine. The undersize discharging scraper mechanism 29 includes a plurality of scrapers supported by a pair of endless chains 32 which are adapted to run around driving sprockets 33 mounted on a pair of rotatable shafts, respectively, one of which is operatively coupled to a driving electric motor 31 (see FIG. 1). Reference numeral 34 shown in FIG. 1 denotes a raw material conveyor.

By virtue of the structure of the vibration-type screening machine according to the present invention, the crushed stone fragments such as those of limestone, sandstone, basalt, andesite and silica can be screened or sieved at a significantly high efficiency particularly owing to the feature that the crushed stone fragments as loaded are fed toward the discharging port while being bounced off from the vibrating upper span section of the endless sieve mesh web 4. Thus, a high screening efficiency can be realized with the vibration-type screening machine according to the invention.

Further, because the woof wires 12 are disposed on the warp wires 13 in the form of transverse beams or offsets, the raw material can pass through the sieve mesh very speedily.

Besides, because the moving speed of the endless sieve mesh web 4 is variable, it is possible to carry out the screening operation optimally by taking into consideration the moisture of the raw material, to another advantage.

Many features and advantages of the present invention are apparent from the detailed description and thus it is intended by the appended claims to cover all such features and advantages of the apparatus which fall within the true spirit and scope of the invention. Further, since numerous modifications and combinations will readily occur to those skilled in the art, it is not intended to limit the invention to the exact construction and operation illustrated and described.

By way of example, the foregoing description has been made on the assumption that the crushed stone fragments are to undergo screening treatment through the vibration-type screening machine. It should however be understood that the invention is never restricted with regard to the materials to be treated. It goes without saying that other loose materials than the crushed stone fragments can be treated by the vibration-type screening machine according to the invention.

Accordingly, all suitable modifications and equivalents may be resorted to, falling within the spirit and scope of the invention.

What is claimed is:

1. A vibration-type screening machine for screening loose material, comprising:

a stationary base frame (1);

a pair of upstanding side plates (3) supported on said stationary base frame (1) through the medium of first spring suspension means (2) and disposed substantially in parallel with each other with a distance therebetween so as to extend longitudinally of said vibration-type screening machine;

a plurality of sieve mesh supporting rollers (5) rotatably mounted between said upstanding side plates (3);

an endless sieve mesh web (4) disposed between said upstanding side plates (3) with an upper span section (4A) thereof being supported on said plurality of sieve mesh supporting rollers (5) so that said endless sieve mesh web (4) can endlessly move in a direction longitudinally of said vibration-type screening machine from a loading port at which said loose material is loaded toward a discharging port thereof at which oversize of said loose material is discharged;

first driving means (17, 17A, 18, 14, 14A, 15) for moving endlessly said endless sieve mesh web (4) in a direction longitudinally of said vibration-type screening machine from said loading port of said vibration-type screening machine toward said discharging port; and eccentric rotary vibrating means (6) disposed at a position near to said loading port and operatively coupled to said pair of upstanding side plates (3) so that said sieve mesh supporting rollers (5) and said upper span section (4A) of said endless sieve mesh web (4) undergo vibration, being driven by said eccentric rotary vibrating means (6), wherein said loose material charged into said vibration-type screening machine is caused to move on and along said upper span section of the endless sieve mesh web (4) from said loading port toward said discharging port with undersize passing through said upper span section (4A) to be discharged laterally through a space defined between said upper span section (4A) and a lower span section (4B) of said endless sieve mesh web, said eccentric rotary vibrating means (6) including:

a pair of bearing blocks (9) supported on said stationary base frame (1) through the medium of said first spring suspension means (2) and disposed at outer sides of said upstanding side plates (3), respectively;

an eccentric cam shaft (8) supported rotatable by said bearing blocks (9), said eccentric cam shaft (8) extending through said upstanding side plates (3) substantially in parallel with said upper span section (4A) of said endless sieve mesh web (4); and second driving means (21, 20, 23) for rotating said eccentric cam shaft (8) in a direction conforming to the direction in which said upper span section of the endless sieve mesh web (4) is moved so that said upper span section (4A) of said endless sieve mesh web (4) undergoes vibration in the course of moving from said loading port toward said discharging port of said vibration-type screening machine.

2. A vibration-type screening machine according to claim 1, further comprising:

an undersize discharging hopper (7) disposed within said space for discharging said undersize in a lateral direction substantially orthogonal to said longitudinal direction.

3. A vibration-type screening machine according to claim 1, wherein said eccentric camshaft (8) is additionally supported rotatably by a pair of bearings (10) mounted on outer wall surfaces of said upstanding side plates (3), respectively, and includes a projecting shaft (8A) and an elongated projecting shaft (8B) both projecting from both ends of said eccentric cam shaft (8), respectively, with eccentricity from a center axis (C) of said eccentric cam shaft (8), wherein said elongated projecting shaft (8B) being operatively coupled to a driving electric motor (21) by way of a pulley (20) and an endless belt (23).

4. A vibration-type screening machine according to claim 3, wherein said driving electric motor (21) is supported resiliently and swingably in a vertical direction.

5. A vibration-type screening machine according to claim 1, wherein said upstanding side plates (3) are mechanically connected to each other by a stopper plate (3A) at an end thereof located at said loading port for preventing the loose material as charged from falling outside of said upper span section (4A) of the endless sieve mesh web (4).

6. A vibration-type screening machine according to claim 1, wherein said upstanding side plates (3) are supported on said stationary base frame (1) through the medium of second spring suspension means (2A) at positions closer to said discharging port of said upper span section (4A) of said endless sieve mesh web (4).

7. A vibration-type screening machine according to claim 1, wherein said endless sieve mesh web (4) is formed of a first layer including a plurality of woof wires (12) extending substantially transversely of said vibration-type screening machine and a second layer including a plurality of warp wires (13) extending substantially longitudinally of said vibration-type screening machine, said first layer of woof wires (12) being disposed on said second layer of warp wires (13) and secured to said second layer of warp wires (13) at intersections between said woof wires (12) and said warp wires (13).

8. A vibration-type screening machine according to claim 7, wherein said woof wires (12) and said warp wires (13) are formed of a synthetic resin.

9. A vibration-type screening machine according to claim 7, wherein said first layer of woof wires (12) and said second layer of warp wires (13) are integrally combined with each other.

10. A vibration-type screening machine according to claim 1, wherein said first driving means includes a variable-speed electric motor (17) so that said endless sieve mesh web (4) can be transported at a speed which can be adjusted.

* * * * *